US006123042A

United States Patent [19]

Visi

[11] Patent Number: 6,123,042

[45] Date of Patent: Sep. 26, 2000

[54] AUTOMATIC SEWING MACHINE

[75] Inventor: William Robert Visi, Lawrenceville, Ga.

[73] Assignee: Durkopp Adler Aktiengesellschaft, Germany

[21] Appl. No.: 09/289,252

[22] Filed: Apr. 9, 1999

[51] Int. Cl.[7] ..... D05B 21/00; D05B 35/04

[52] U.S. Cl. ..... 112/470.16; 112/114; 223/38

[58] Field of Search ..... 112/470.16, 470.07, 112/470.06, 470.14, 104, 113, 114, 475.06, 475.09; 223/37, 38

[56] References Cited

U.S. PATENT DOCUMENTS 5,611,468 3/1997 Schulze et al. ..... 112/470.16 X 5,915,318 6/1999 Iwasaki et al. ..... 112/470.16

*Primary Examiner*—Peter Nerbun

*Attorney, Agent, or Firm*—Robert F. I. Conte; Lee Mann Smith McWilliams Sweeney & Ohlson

[57] ABSTRACT

An automatic sewing machine comprises a folding device and a guiding and feeding device for a folded workpiece and a main workpiece on which to sew the folded workpiece. The folding device comprises an outer frame with creasing modules which have folding bars. The creasing modules are mounted on the outer frame in a manner adjustable in their direction of extraction and approximately crosswise thereto.

12 Claims, 3 Drawing Sheets

AUTOMATIC SEWING MACHINE

BACKGROUND OF THE INVENTION

1. Field of the Invention

The invention relates to an automatic sewing machine comprising a stand; a carrier plate disposed on the stand; a folding device for at least one workpiece, which is allocated to the carrier plate and which comprises an outer frame, which is movable at least between an upper position and a lower position on the carrier plate, which at least substantially encloses a recess, which is equipped with creasing modules, and which comprises folding bars attached to the creasing modules and located in the recess and displaceable in the direction of extraction of the creasing modules, and which folding device comprises a folding sword, which has outer edges allocated and adapted to the folding bars, which is movable into the recess, and which is releasably and replaceably mounted on a sword holder; a sewing machine having an upper arm disposed above the carrier plate; and a guiding and feeding device, which comprises a workpiece holder for the transfer of at least two workpieces from the folding device to the sewing machine and for guidance on the sewing machine during a sewing operation.

2. Background Art

An automatic sewing machine of the generic type known from U.S. Pat. No. 4,819,572 can be adjusted to varying sizes of pockets to be folded only by replacement of the outer frame which includes the creasing modules and the folding bars. The folding sword, which is a component part relevant to the size and shape of the pocket, is equally replaced. Also the workpiece holder has a defmed size; it consists of a plate having a slit that corresponds to the pocket seam to be sewn.

SUMMARY OF THE INVENTION

It is an object of the invention to embody an automatic sewing machine of the generic type such that adaptation to workpieces that are to be folded and sewn to form pockets of varying size is feasible by simple means.

According to the invention this object is attained by the features wherein at least one creasing module is mounted on the outer frame in a manner adjustable in the direction of extraction and approximately crosswise thereto. The measures according to the invention ensure that the outer frame of the folding device can be sized to accommodate a pocket piece provided for as great as possible a pocket. In like manner, the outer frame can lodge the folding sword provided for as great as possible a pocket. This helps achieve high flexibility of the folding device; only the sword has to be replaced and the folding bars have to be adjusted by means of the creasing modules being regulated according to the invention. An advantageous and simple possibility of adjustment is achieved by means of oblong-hole-type connections between the creasing modules and the outer frame.

A further embodiment of the workpiece holder equally serves for the purpose of increasing the flexibility and must therefore be seen preferably in combination with the adjustability of the folding device. Of course, this embodiment can also be used independently thereof. It is substantial for this further embodiment that the pressing plate, which bears on the folded pocket piece, leaving free an outer margin, is a component independent of the pressure frame and that again the pressure frame rests exclusively on the main workpiece and not on the folded pocket piece.

Further features, advantages and details of the invention will become apparent from the ensuing description of an exemplary embodiment, taken in conjunction with the drawing.

DESCRIPTION OF THE PREFERRED EMBODIMENT

Figure 1:
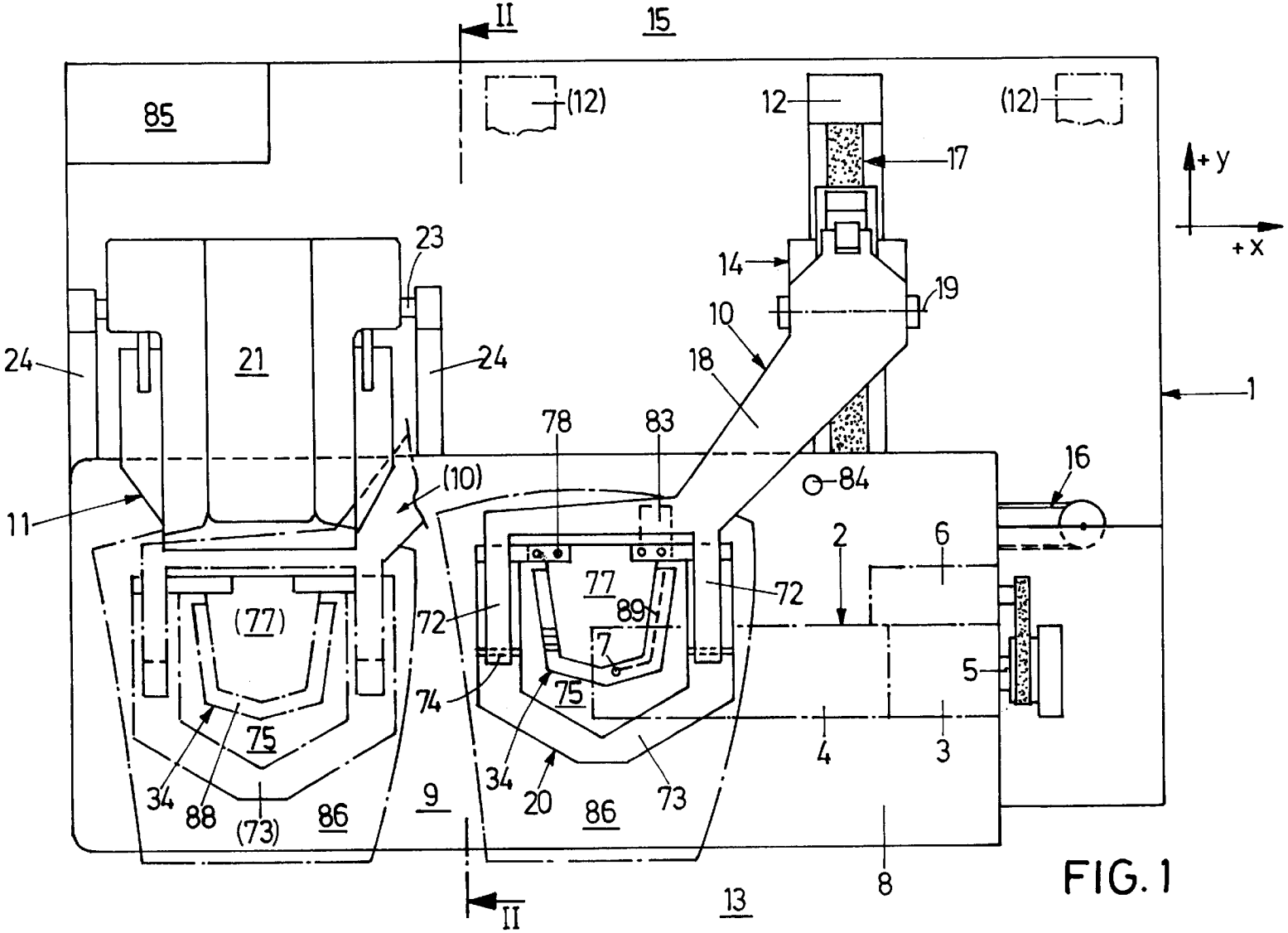
FIG. 1 is a plan view of an automatic sewing machine according to the invention.

The automatic sewing machine only roughly outlined in FIG. 1 comprises a stand 1, on which a sewing machine 2 outlined by dot-dash lines is stationarily disposed. Conventionally it consists of a base plate (not shown), a standard 3 and an upper arm 4. An arm shaft 5 to be driven by an electric drive motor 6 is customarily mounted in the arm 4 of the sewing machine 2. The drive of a needle bar with a needle 7 and of a hook located in the base plate is conventionally derived from the arm shaft 5.

A carrier plate 8 is disposed on the stand 1, its upper side defining a sewing plane 9. This carrier plate 8 is disposed above the base plate of the sewing machine 2 and comprises a stitch hole which permits the needle 7 to pass through to the hook and which, in the illustration of FIG. 1, coincides with the needle 7.

Mounted on the stand 1 is a guiding and feeding device 10, by means of which workpieces are fed from a preparatory station, namely a folding device 11, to the sewing machine 2, are guided there during the sewing operation and moved away subsequently.

The guiding and feeding device 11 comprises an x carriage 12 which performs motions in the horizontal plane in the x direction, i.e. from the folding device 11 to the sewing machine 2 and back again, consequently from the left to the right and from the right to the left, referred to the viewing direction from the operator's side 13. A y carriage 14 is disposed on the x carriage 12, performing motions in the horizontal plane in the y direction, i.e. from the operator's side 13 in the direction towards the rear side 15 of the automatic sewing machine and back again. The x carriage 12 is guided on the stand 1 for displacement in the x direction. By means of an x drive 16 it is displaced in the x direction between two stop positions roughly outlined by dot-dash lines in FIG. 1. The y carriage 14 is supported and guided on the x carriage 12. A y drive 17 is provided for the displacement of the y carriage 14 on the x carriage 12. A double cranked lever 18 is mounted on the y carriage 14 pivotally about a pivot axis 19 which extends in the x direction. A workpiece holder 20 is attached to the free end of the lever 18 that faces away from the y carriage 14. The design of the automatic sewing machine herein described is known from U.S. Pat. No. 5,697,311, to which reference is made for further details.

Figure 2:
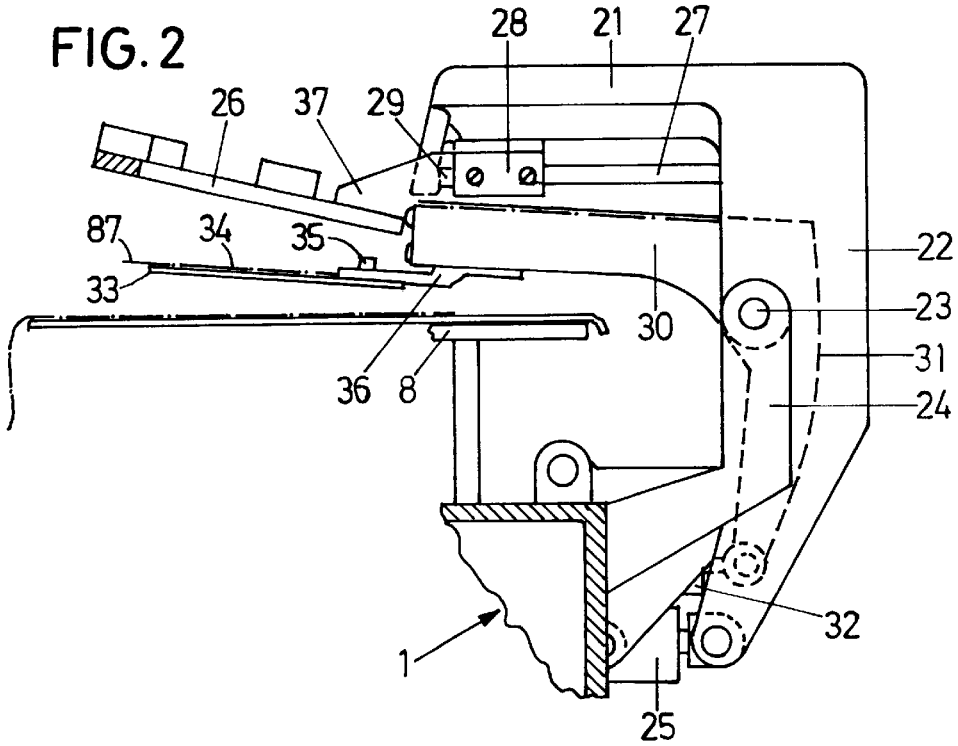
FIG. 2 is a vertical partial section through the automatic sewing machine on the section line II—II of FIG. 1.

As seen in particular in FIG. 2, the folding device 11 has a cover-type carrier 21 which is disposed above the carrier plate 8, partially projecting there-over towards the rear side 15 of the stand 1. At its end on the rear side, the carrier 21 has a lever arm 22 projecting downwards. Where passing into the lever arm 22, the carrier 21 is mounted pivotally about a pivot axle 23 which extends in the x direction and is retained in two bearing arms 24 which are mounted on the stand 1. Engaging on the lower end of the lever arm 22 is an outer frame tilt drive 25 which is a pneumatically actuated three-position piston-cylinder drive which, apart from being positioned in two end positions, can also be positioned in an intermediate position, whereby the carrier 21 and thus an outer frame 26 supported by this carrier 21 can be positioned in three different tilt positions. The tilt drive 25 supports itself on the stand 1.

Two parallel guide bars 27 are arranged in the carrier 21, which extend perpendicular to the x direction and on which the outer frame 26 is slidably guided by means of a slide bearing 28. When the carrier is in the position pivoted upwards as illustrated in FIG. 2, the guide bars 27 extend approximately parallel to the carrier plate 8, i.e. in the y direction. An outer frame displacing drive 29 is disposed between the guide bars 27 in the carrier 21, engaging on the slide bearings 28. A sword carrier 30 is pivotally mounted on the tilt axle 23; it is disposed substantially below the outer frame carrier 21 and in particular below the guide bars 27. Formed on the rear end of this sword carrier 30 is an arm 31 which extends downwards and is substantially disposed within the lever arm 22. A sword tilt drive 32, by means of which the sword carrier 30 is pivotal about the tilt axle 23, engages on the lower end of this arm 31. In the sword carrier 30, provision is made for a guide and mount for a folding sword 33, which is displaceable between two stop positions by a sword displacing drive. The design and function of the folding device 11 so far described are known from U.S. Pat. No. 4,819,572 to which reference is made for further details.

Customarily, the sword 33 has a contour corresponding to the shape of a workpiece 34 to be folded for instance to form a pocket piece. It is very thin, for example made of spring steel. For the user to be able himself to prepare and replace such a sword 33 that complies with his requirements, the sword 33 is replaceably fixed by screws 35 on a sword holder 36.

The outer frame is approximately U-shaped and fixed to slide bearings 28 by means of webs 37. For the workpiece 34, which is to form a pocket, to be folded around the outer edges 38, 39, 40, 41 of the sword 33, the outer frame has so-called creasing modules 42, 43, 44, 45 on its circumference, which are standard pneumatically actuated units known and general practice in automatic sewing. The outer frame 26 has a recess 46, in the marginal zone of which folding bars 47, 48, 49, 50 are located, which are allotted to the outer edges 38 to 41 of the sword 33. The folding bars 47 to 50 are mounted each on the slide 51 of the respective creasing module 42 to 45. A securing plate 53 is mounted on the outer frame 26 by means of a bridge web 52, partially covering the central portion of the recess 46. The peripheral edges 54, 55, 56 are disposed so that they do not at any place cover the outer edges 38 to 41 of the sword 33, namely of the smallest possible sword 33 to be used. Consequently, the securing plate 53, where overlapping a workpiece 34 to be folded to form a pocket, is smaller than this workpiece 34 in the area where it is folded around the outer edges 38 to 41 of the sword 33.

The creasing modules 42 to 45 are mounted on the outer frame 26 for adjustment in their lengthwise direction, i.e. in the direction of extraction 57 of their slides 51, and substantially crosswise thereto. To this end, oblong holes 62 are formed in the legs 58, 59 of the outer frame 26, which are parallel to each other and allocated to the creasing modules 42 and 45, and in the webs 60, 61 of the outer frame 26, which are of V-shaped arrangement relative to each other and allocated to the creasing modules 43 and 44; the oblong holes 62 extend approximately in the lengthwise direction of the legs 58 and 59 and of the webs 60, 61. Further, each creasing module 42 to 45 has a rib-type holding flange 63 on its two side walls, an oblong hole 64 which extends in parallel to the direction of extraction 57 being formed in the holding flange 63. On the lower side of the legs 58, 59 and of the webs 60, 61, respectively, the oblong holes 62 are provided with a rear recess 65.

Figure 3:
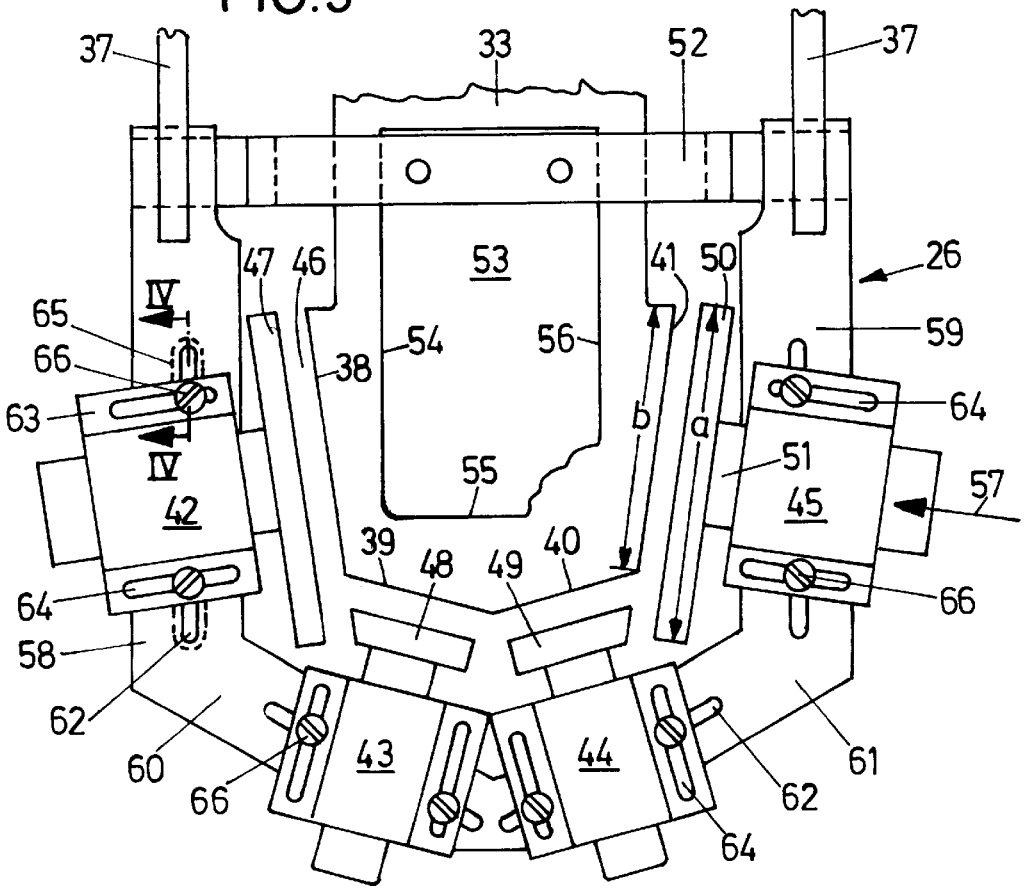
FIG. 3 is a plan view, on an enlarged scale as compared to FIG. 2, of the outer frame and the folding sword according to the arrow III of FIG. 2.
Figure 4:
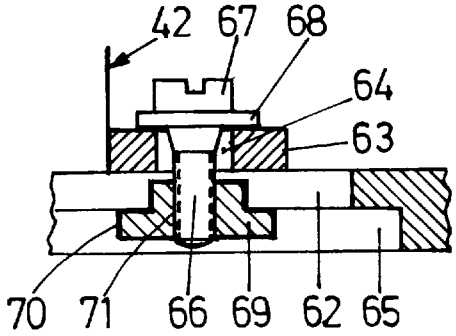
FIG. 4 is a partial cross section through the outer frame on the section line IV—IV of FIG. 3.

Fixing the creasing modules 42 to 45 to the outer frame 26 is effected by a screw 66 being pushed from above through the oblong hole 64 in the respective holding flange 63, the head 67 of which supports itself on a washer 68 on the upper side of the respective holding flange 63. A nut 69 is inserted from below into the respective oblong hole 62, its projecting lower edge 70 engaging with the rear recess 65. It passes upwards at least partially through the oblong hole 62. The screw 66 is screwed into an adapted threaded hole 71 of the nut 69. As long as the screw connection has not yet been tightened, a creasing module 42 to 45 together with the two associated screws 66 and the two nuts 69 can be shifted in the oblong hole 62 as a result of the specified design. Moreover, the respective creasing module 42 to 45 can be shifted in the direction of its two oblong holes 64. In the correct position of the creasing module 42 to 45 and of the folding bars 47 to 50, respectively, the two screws 66 are tightened, whereby the position of the creasing module 42 to 45 is fixed. As a result of the specified possibilities of adjustment, the folding bars 47 to 50 can be widely adjusted in their basic orientation, corresponding to the course of the outer edges 38 to 41 of the respective sword 33 employed. As seen in particular in FIG. 3, the two folding bars 47 and 50 which serve for folding the longitudinal edges of the workpiece considered the pocket piece have a length a which is approximately the same as the greatest possible length b of the associated outer edges 38, 41. A corresponding relation need not apply to the comparatively small folding bars 48, 49, since the corresponding outer edges 39, 40 are clearly shorter than the outer edges 38, 41. Of course, the folding bars 47 to 50 have to be oriented and adjusted so that they will not collide with each other when moved under the sword 33.

Figure 5:
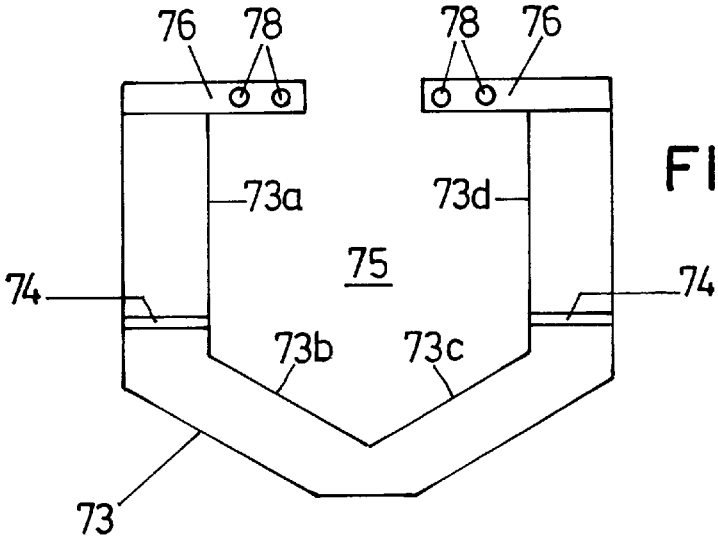
FIG. 5 is a plan view of the pressing frame of the workpiece holder.
Figure 6:
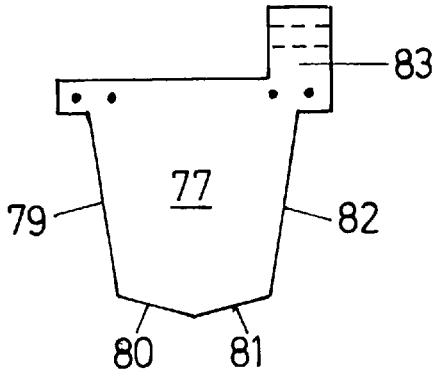
FIG. 6 is a plan view of the pressing plate of the workpiece holder.

At the end of the lever 18 turned towards the workpiece holder 20, the lever 18 has the shape of a U open towards the operator's side 13. On the lower side of the supporting webs 72 directed towards the operator's side 13 and extending in the y direction, a pressing frame 73—illustrated in FIG. 5—is mounted to be adjustable about leveling axes 74 which extend in the x direction. The pressing frame 73 has a recess 75 which is defined by inner edges 73*a*, 73*b*, 73*c*, 73*d* and which exceeds the size of the greatest possible folded workpiece 34. In its portion turned toward the lever 18, the pressing frame 73 comprises retaining ribs 76 projecting inwards and partially closing the recess 75 and on which a pressing plate 77 is replaceably fixed by means of screws 78. This pressing plate 77 is smaller than the sword 33 and has outer edges 79, 80, 81, 82 which, when the sword 33 and the pressing plate 77 are placed one above the other, would extend approximately parallel to, and within, the outer edges 38 to 41. Mounted on the pressing plate 77 is a coding unit 83, the side of which turned towards the carrier plate 8 is provided with a codification. Allocated thereto is a sensor 84 which is provided in or on the carrier plate 8, scanning the data stored in the coding unit 83 and passing them to the control unit 85 of the automatic sewing machine.

The Mode of Operation is as Follows

Prior to the beginning of a sewing series, the workpiece holder 20 has been displaced so that the data located on the coding unit 83 have been read into the control unit 85 by the sensor 84 and a corresponding sewing program has been read out of the control unit 85 and activated. Each individual folding operation and subsequent sewing operation starts by the workpiece holder 20 being for instance in a sewing position on the sewing machine 2. The folding device 11 has the initial position seen in FIG. 2, i.e. the outer frame 26 and the sword 33 are in their position pivoted upwards. The outer frame 26 has not yet been moved into the position (not shown) in the direction towards the rear side 15. The operator places a main workpiece 86, for example a rear trouser part, under the sword 33 on the carrier plate 8, there aligning it based on the available markings. Subsequently, the operator places the workpiece 34 on the sword 33 and triggers the outer frame 26 to move into the position seen in FIG. 2 and then to lower onto the sword 33 in the upward position thereof illustrated in FIG. 2. In this position, the securing plate 53 prevents the workpiece 34 from slipping on the sword 33. Then the creasing modules 42 to 45 are actuated so that the margins 87 of the workpiece 34 which project over the outer edges 38 to 41 are folded by means of the folding bars 47 to 50 around the outer edges 38 to 43 under the sword 33. Then the outer frame 26 together with the sword 33 is lowered onto the main workpiece 86 on the carrier plate 8. The folding bars 47 to 50 are moved into their retracted position seen in FIG. 3; the outer frame 26 is again pivoted upwards into the position seen in FIG. 2 and moved in the direction towards the rear side 15. The workpiece 34, which is folded to form a pocket piece, is held on the main workpiece 86 by means of the sword 33 which is very thin.

Then the workpiece holder 20 is moved into the vicinity of the folding device 11 and lowered onto the workpieces 34, 86. This position of the workpiece holder 20 is illustrated by dot-dash lines in FIG. 1. Due to the specified ratios of dimensions, the pressing frame 73 is placed exclusively on the main workpiece 86, whereas the pressing plate 77 is placed only on the workpiece 34 folded around the sword 33, there sparing a marginal zone 88 due to the specified ratios of dimensions. The outer edges 79 to 82 extend parallel to the contour of the folded workpiece 34. The pressing plate 77 presses the folded workpiece 34 on the main workpiece 86 and both jointly on the carrier plate 8.

Once the two workpieces 34, 86 have been pressed by the workpiece holder 20 firmly on the carrier plate 8, the sword 33 is removed from the folded workpiece 34 in the direction towards the rear side 15.

Then the guiding and feeding device 10 moves the workpiece holder 20 to the sewing machine 2, where the two workpieces 34, 86 are sewn together by means of a seam 89 in the marginal zone 88. In as much as the operating sequences of folding the workpiece 34, the transfer to the sewing machine 2 and the guidance of the workpieces 34, 86 under the sewing machine 2 are concerned, these jobs are known for example from U.S. Pat. No. 4,819,572.

What is claimed is:

1. An automatic sewing machine, comprising a stand (1);

a carrier plate (8) disposed on the stand (1);

a folding device (11) for at least one workpiece (34), which is allocated to the carrier plate (8), and which comprises an outer frame (26), which is movable at least between an upper position and a lower position on the carrier plate (8), which at least substantially encloses a recess (46), which is equipped with creasing modules (42 to 45), and which comprises folding bars (47 to 50) attached to the creasing modules (42 to 45) and located in the recess (46) and displaceable in a direction of extraction (57) of the creasing modules (42 to 45), and which folding device (11) comprises a folding sword (33), which has outer edges (38 to 41) allocated and adapted to the folding bars (47 to 50), which is movable into the recess (46), and which is releasably and replaceably mounted on a sword holder (36);

a sewing machine (2) having an upper arm (4) disposed above the carrier plate (8); and a guiding and feeding device (10), which comprises a workpiece holder (20) for the transfer of at least two workpieces (34, 86) from the folding device (11) to the sewing machine (2) and for guidance on the sewing machine (2) during a sewing operation, wherein at least one creasing module (42 to 45) is mounted on the outer frame (26) in a manner adjustable in the direction of extraction (57) and approximately crosswise thereto.

2. An automatic sewing machine according to claim 1, wherein at least one oblong hole (64) is formed on the at least one creasing module (42 to 45), the oblong hole (64) being penetrated by a pin (66) which is joined to the outer frame (26).

3. An automatic sewing machine according to claim 1, wherein at least one oblong hole (62) is formed on the outer frame (26), the oblong hole (62) being penetrated by a pin (66) which is joined to at least one creasing module (42 to 45).

4. An automatic sewing machine according to claim 1, wherein at least one oblong hole (64) is formed on the creasing module (42 to 45);

wherein at least one oblong hole (62) is formed on the outer frame (26); and wherein the at least one oblong hole (64) on the creasing module (42 to 45) and the at least one oblong hole (62) on the outer frame (26) are penetrated by a common pin (66).

5. An automatic sewing machine according to claim 4, wherein the at least one oblong hole (64) on the creasing module (42 to 45) extends in said direction of extraction (57).

6. An automatic sewing machine according to claim 4, wherein the pin (66) bears against the creasing module (42 to 45) by a first holding member (67) and engages on the lower side of the outer frame (26) by a second holding member (69).

7. An automatic sewing machine according to claim 6, wherein the second holding member (69) engages with a rear recess (65) of the oblong hole (62).

8. An automatic sewing machine according to claim 2, wherein the at least one oblong hole (64) on the creasing module (42 to 45) extends in said direction of extraction (57).

9. An automatic sewing machine according to claim 1, wherein the workpiece holder (20) comprises a pressing frame (73) with inner edges (73*a* to 73*b*) which, when the workpiece holder (20) and the folding sword (33) are one above the other in the folding device (11), are spaced from the outer edges (38 to 41) of the folding sword (33) and are disposed outside thereof;

wherein the workpiece holder (20) comprises a pressing plate (77) disposed within the pressing frame (73) and having outer edges (79 to 82) which, when the workpiece holder (20) and the folding sword (33) are one above the other in the folding device (11), are spaced from the outer edges (38 to 41) of the folding sword (33) and are disposed within the outer edges (38 to 41) of the folding sword (33), sparing a marginal zone (88) of the folding sword (33); and wherein the pressing frame (73) and the pressing plate (77) are releasably and replaceably connected to each other.

10. An automatic sewing machine according to claim 1, wherein the outer edges (79 to 82) of the pressing plate (77) extend substantially parallel to the outer edges (38 to 41) of the folding sword (33).

11. An automatic sewing machine, comprising a stand (1);

a carrier plate (8) disposed on the stand (1);

a folding device (11) for at least one workpiece (34), which is allocated to the carrier plate (8), and which comprises an outer frame (26), which is movable at least between an upper position and a lower position on the carrier plate (8), which at least substantially encloses a recess (46), which is equipped with creasing modules (42 to 45), and which comprises folding bars (47 to 50) attached to the creasing modules (42 to 45) and located in the recess (46) and displaceable in a direction of extraction (57) of the creasing modules (42 to 45), and which folding device (11) comprises a folding sword (33), which has outer edges (38 to 41) allocated and adapted to the folding bars (47 to 50), which is movable into the recess (46), and which is releasably and replaceably mounted on a sword holder (36);

a sewing machine (2) having an upper arm (4) disposed above the carrier plate (8); and a guiding and feeding device (10), which comprises a workpiece holder (20) for the transfer of at least two workpieces (34, 86) from the folding device (11) to the sewing machine (2) and for guidance on the sewing machine (2) during a sewing operation, wherein the workpiece holder (20) comprises a pressing frame (73) with inner edges (73*a* to 73*d*) which, when the workpiece holder (20) and the folding sword (33) are one above the other in the folding device (11), are spaced from the outer edges (38 to 41) of the folding sword (33) and are disposed outside thereof;

wherein the workpiece holder (20) comprises a pressing plate (77) disposed within the pressing frame (73) and having outer edges (79 to 82) which, when the workpiece holder (20) and the folding sword (33) are one above the other in the folding device (11), are spaced from the outer edges (38 to 41) of the folding sword (33) and are disposed within the outer edges (38 to 41) of the folding sword (33), sparing a marginal zone (88) of the folding sword (33);

wherein the pressing frame (73) and the pressing plate (77) are releasably and replaceably connected to each other; and wherein a coding unit (83) is mounted on the pressing plate (77), a sensor (84) on the carrier plate (8) being allocated to the coding unit (83).

12. An automatic sewing machine according to claim 11, wherein the outer edges (79 to 82) of the pressing plate (77) extend substantially parallel to the outer edges (38 to 41) of the folding sword (33).

* * * * *